US010207844B2

(12) United States Patent
Thukral et al.

(10) Patent No.: US 10,207,844 B2
(45) Date of Patent: Feb. 19, 2019

(54) DROPPER

(71) Applicant: Berry Plastics Corporation, Evansville, IN (US)

(72) Inventors: Preeti Thukral, Bengaluru (IN); Alok Das, Bengaluru (IN); Lovwin Banna, Karnataka (IN)

(73) Assignee: Berry Plastics Corporation, Evansville, IN (US)

( * ) Notice: Subject to any disclaimer, the term of this patent is extended or adjusted under 35 U.S.C. 154(b) by 31 days.

(21) Appl. No.: 15/241,189

(22) Filed: Aug. 19, 2016

(65) Prior Publication Data

US 2017/0057709 A1 Mar. 2, 2017

(30) Foreign Application Priority Data

Aug. 26, 2015 (IN) ..... 4496/CHE/2015

(51) Int. Cl.
*B65D 47/18* (2006.01)
*B65D 47/26* (2006.01)

(52) U.S. Cl.
CPC ..... *B65D 47/18* (2013.01); *B65D 47/263* (2013.01)

(58) Field of Classification Search
CPC ... B65D 47/18; B65D 47/263; B05C 11/1002; B05C 11/1034
See application file for complete search history.

(56) References Cited

U.S. PATENT DOCUMENTS 1,273,919 A * 7/1918 Peed ..... B65D 47/18 222/421
1,973,459 A * 9/1934 Anderson ..... B65D 47/2031 222/490
2,193,517 A * 3/1940 Lindstrom ..... B65D 47/2031 222/48
2,309,895 A * 2/1943 Griffith ..... B65D 47/2037 222/490
2,378,061 A * 6/1945 Buhler ..... B65D 35/38 222/494
2,576,403 A * 11/1951 Kirschenbaum ..... B65D 47/18 222/421
2,594,040 A * 4/1952 Le Clair ..... F16N 21/04 184/105.3

(Continued)

FOREIGN PATENT DOCUMENTS

| | | |
|---|---|---|
| EP | 1520797 | 4/2005 |
| FR | 3010987 | 3/2015 |
| WO | 2011030063 | 3/2011 |

OTHER PUBLICATIONS

Extended European Search Report for European Application No. 16001837.0 dated Oct. 7, 2016, BP-477F EP || 9 pages.

*Primary Examiner* — Paul R Durand
*Assistant Examiner* — Randall Gruby
(74) *Attorney, Agent, or Firm* — Barnes & Thornburg LLP

(57) ABSTRACT

A package includes a container and a lid. The container includes a body formed to include an interior product-storage region and neck coupled to the body and formed to include a mouth opening into the interior-product storage region. The lid is coupled the neck of the container and formed to include a portion of a droplet passageway therein which is arranged to extend along a longitudinal axis of the lid. The droplet passageway is adapted to communicate a droplet of fluid from the interior region to environment surrounding the package.

18 Claims, 6 Drawing Sheets

(56) References Cited

U.S. PATENT DOCUMENTS 2,628,004 A * 2/1953 Schlicksupp ..... B65D 47/2081 222/493
2,679,336 A * 5/1954 Frick ..... B65D 47/2018 137/853
2,695,119 A * 11/1954 Kishpaugh ..... B65D 35/20 137/514
2,935,231 A * 5/1960 Ambrose ..... B65D 35/242 222/94
3,010,619 A * 11/1961 Gronemeyer ..... B65D 47/242 222/521
3,102,651 A * 9/1963 Boese ..... B65D 47/18 215/307
3,118,578 A * 1/1964 Collins ..... B65D 47/263 215/307
3,302,833 A * 2/1967 Lcika ..... B65D 35/24 219/214
3,348,744 A * 10/1967 Morin ..... B65D 47/2081 222/494
3,578,223 A * 5/1971 Armour ..... B65D 47/242 222/521
3,684,137 A * 8/1972 Coleman ..... B65D 47/2037 222/490
4,253,588 A * 3/1981 Lester ..... B65D 47/247 215/270
4,561,570 A * 12/1985 Zulauf ..... B65D 47/242 222/153.14
4,585,149 A * 4/1986 Zulauf ..... B65D 81/3244 222/144.5
4,877,624 A * 10/1989 Floyd ..... A23L 3/10 426/241
5,004,127 A * 4/1991 Morel ..... B05B 11/0027 222/505
5,154,325 A * 10/1992 Ryder ..... B05B 11/047 222/189.06
5,158,213 A * 10/1992 Lataix ..... B29C 49/20 215/48
5,207,659 A * 5/1993 Pennaneac'h ..... A61F 9/0008 222/340
5,238,153 A * 8/1993 Castillo ..... B05B 11/0072 222/189.09
5,240,149 A * 8/1993 Schmidt ..... B05B 11/043 137/102
5,431,310 A * 7/1995 Kanner ..... B05B 11/0021 222/212
6,244,476 B1 * 6/2001 Moretti ..... B65D 47/242 222/520
6,974,053 B2 * 12/2005 Lautre ..... B65D 47/2081 222/212
8,616,418 B2 * 12/2013 Painchaud ..... B05B 11/0021 222/212
8,714,408 B2 * 5/2014 Pozzi ..... A61F 9/0008 222/108
8,783,521 B2 * 7/2014 Ishikawa ..... A61F 9/0008 137/859
9,931,655 B2 * 4/2018 Carraro ..... B05B 11/047
2005/0173456 A1 * 8/2005 Backes ..... B65D 47/18 222/212
2005/0258282 A1 * 11/2005 Hagihara ..... B05B 11/047 239/571
2017/0080442 A1 * 3/2017 Carraro ..... B65D 35/38

* cited by examiner

DROPPER

PRIORITY CLAIM

This application claims priority to Indian Application No. 4496/CHE/2015, filed Aug. 26, 2015, which is expressly incorporated by reference herein.

BACKGROUND

The present disclosure relates to a package, and particularly to a package including a container and a closure. More particularly, the present disclosure relates to package configured to dispense drops of fluid stored in the container through the closure.

SUMMARY

According to the present disclosure, a package includes a container and a lid coupled to the container. The container is formed to include an interior product-storage region which is adapted to store liquids therein. The lid is configured to allow selective discharge of fluids from the interior product-storage region through the lid for use by a consumer.

In illustrative embodiments, the package further comprises a droplet controller coupled to the lid. The droplet controller is configured control discharge of a droplet of fluid stored in the interior region in response to pressurization of the fluid in the interior region of the container so that a pre-determined size of the droplet and a predetermined rate of discharging the droplet occurs when the package is in any orientation and pressure is applied to the fluid stored in the interior product-storage region.

In illustrative embodiments, the droplet controller includes a male control unit and a female control unit. The male control unit is coupled to the lid and arranged to extend downwardly toward the container. The female control unit is coupled to the lid in spaced-apart relation to the male control unit to define a flow-control passageway therebetween. Fluid flows from the interior-product storage region in a downstream direction away from the container through an outer section of the flow-control passageway, in an inward direction toward a longitudinal axis of the lid through an annular damping chamber of the flow-control passageway, and in an upstream direction toward the container through an inner section of the flow-control passageway before passing into a droplet passageway formed in the lid.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a diagrammatic and partial perspective view of a package in accordance with the present disclosure showing that the package includes a closure coupled to a neck of a container and suggesting that a droplet controller included in the closure is configured control a size and rate of drops of fluid coming out of the closure through the use a male control unit and a female control unit included in the droplet controller;

FIG. 2 is a sectional view taken along line 2-2 of FIG. 1 showing that the closure includes a lid coupled to the neck of the container and a droplet controller including the male control unit appended to the lid and a female control unit coupled to the lid in spaced-apart relation to the male control unit to define a flow-control passageway between the male control unit, female control unit, and lid to cause fluid to flow as suggested by the solid single arrows;

DETAILED DESCRIPTION

Figure 1:
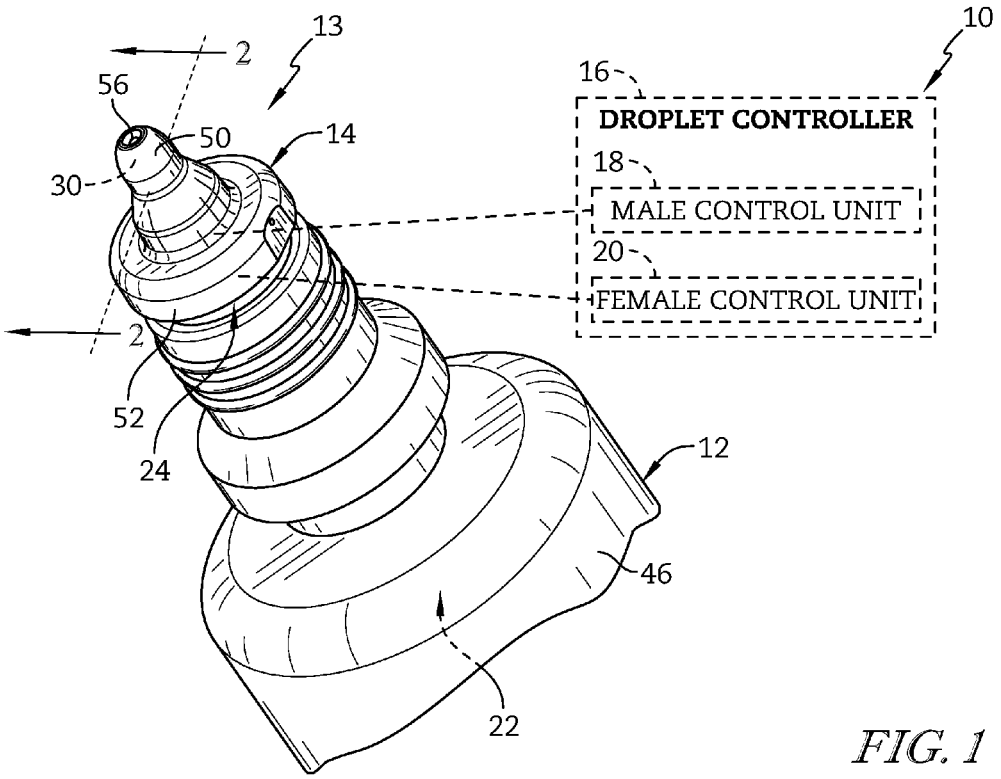
Figure 2:
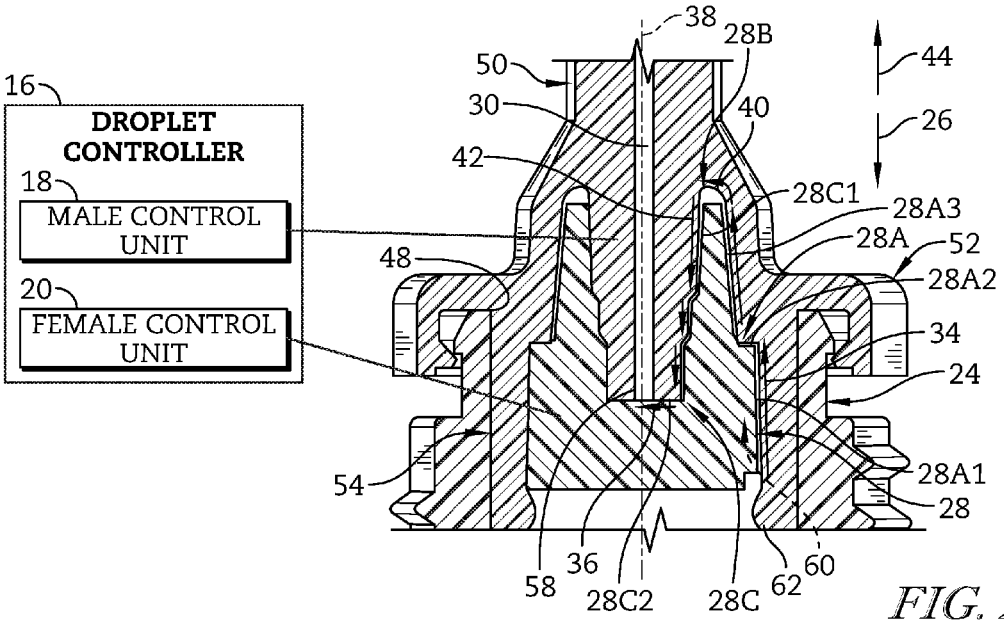
Figure 3:
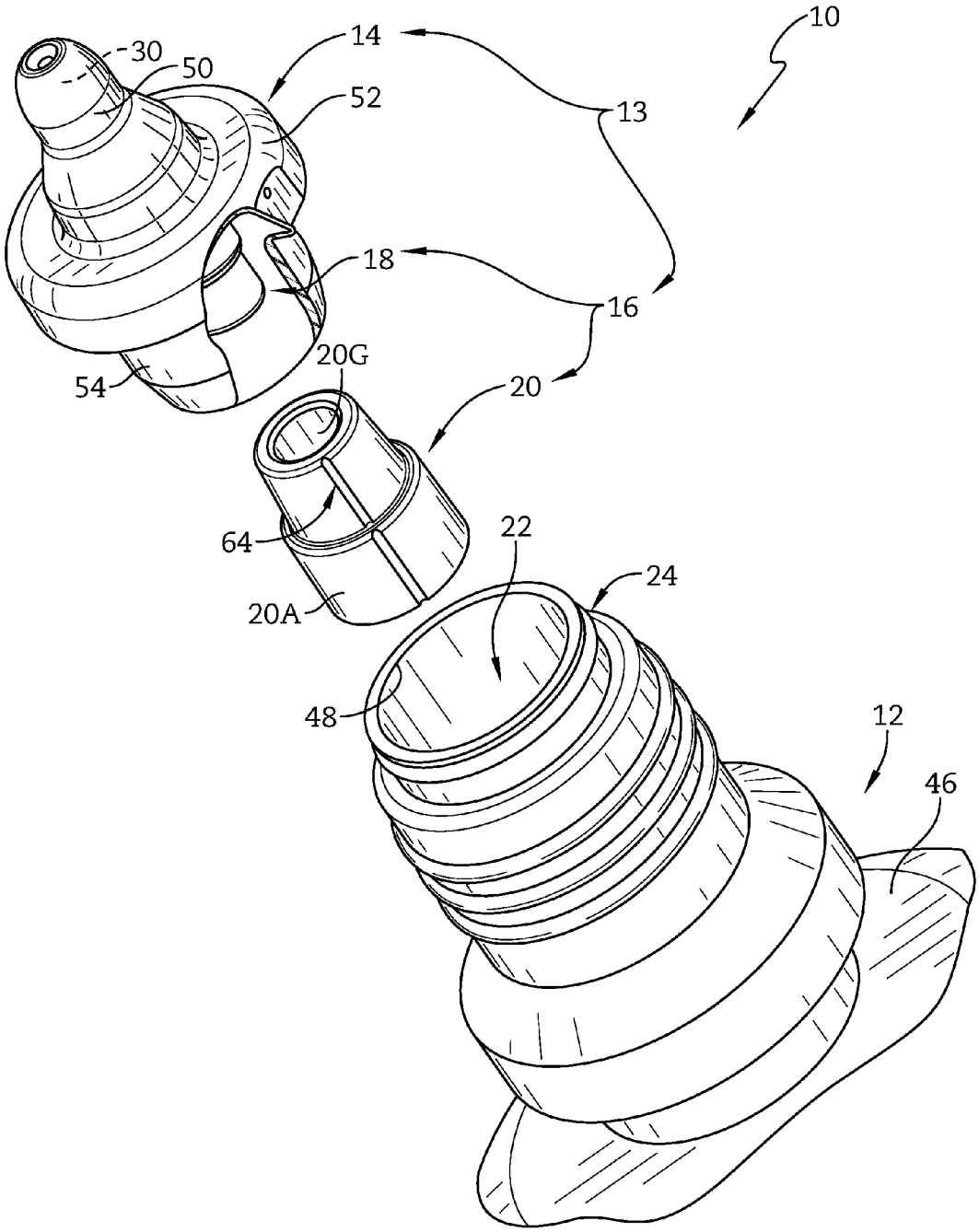
FIG. 3 is an exploded assembly view of the package of FIG. 1 showing that the package includes, from top left to bottom right, that the closure includes the lid and the male control unit appended to the lid, the female control unit, and the container.

A first embodiment of a package 10 in accordance with the present disclosure is shown in FIGS. 1-3. Package 10 includes a container 12, a lid 14 coupled to container 12, and a droplet controller 16 as shown in FIGS. 1-3. Droplet controller 16 includes a male control unit 18 and a first embodiment of a female control unit 20 as shown in FIGS. 2-7, 9 and 10. The male and female control units 18, 20 cooperate to provide means for controlling discharge of a droplet of fluid stored in container 12 in response to pressurization of the fluid in container 12 so that a pre-determined droplet size of the droplet and a predetermined droplet-delivery rate of discharging the droplet occurs when package 10 is in any orientation and pressure is applied to the fluid stored in container 12. Additional embodiments for female control units 120, 220, 320, 420, 520, 620 in accordance with the present disclosure are shown in FIGS. 11-16.

Package 10 includes container 12 and a closure 13. Closure 13 is coupled to container 12 and configured to dispense a droplet of fluid stored in an interior product-storage region 22 of the container 12 with a predetermined droplet size and a predetermined droplet-delivery rate. In one example, the fluid is a medicine which is dispensed into the eye of a user with the predetermined droplet size and the predetermined droplet-delivery rate.

Closure 13 includes lid 14 and droplet controller 16. Lid 14 is coupled to a neck 24 included in container 12. Droplet controller 16 is coupled to lid 14 to move therewith and be retained with lid 14 when lid 14 is separated from neck 24. Droplet controller 16 is configured to provide means for controlling discharge of a droplet of fluid stored in container 12 in response to pressurization of the fluid in container 12 so that a pre-determined droplet size and a predetermined droplet-delivery rate occur when package 10 is in any orientation and pressure is applied to the fluid stored in container 12 as shown in FIGS. 1-3. Orientations of the container include an upright orientation in which container 12 is located between lid 14 and ground underlying package 10, an upside-own orientation in which lid 14 is located between container 12 and ground underlying package 10, a horizontal orientation in which lid 14 and container 12 about equally spaced apart from ground underlying package 10, and any other suitable orientation.

Droplet controller 16 includes male control unit 18 and female control unit 20 as shown in FIGS. 1-7. Male control unit 18 is coupled to lid 14 in a fixed position relative to lid 14 and arranged to extend in a downward direction 26 away from lid 14 toward container 12 as shown in FIGS. 2 and 4-7. Female control unit 20 is coupled to lid 14 to move therewith. Female control unit 20 is arranged to lie in spaced apart relation from male control unit 18 to locate female control unit 20 between male control unit 18 and container 12.

Figure 6:
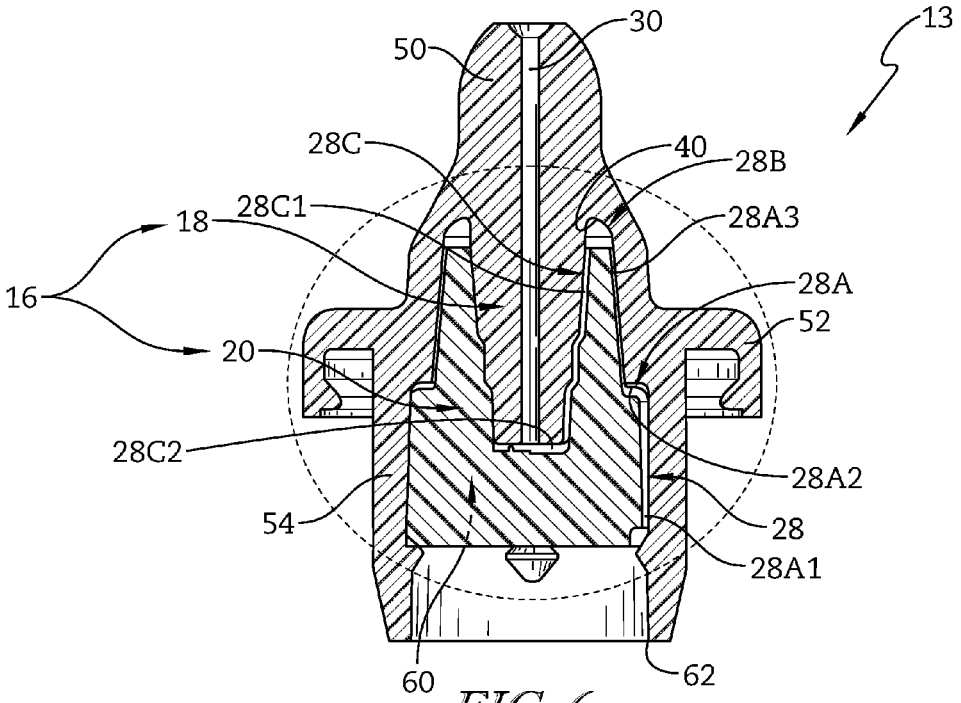
FIG. 6 is a view similar to FIG. 4 after the female has been coupled to the lid and retained in place by a set of female control-unit retainers appended to the lid and suggested that the flow-control passageway is formed along a right side of the closure.
Figure 7:
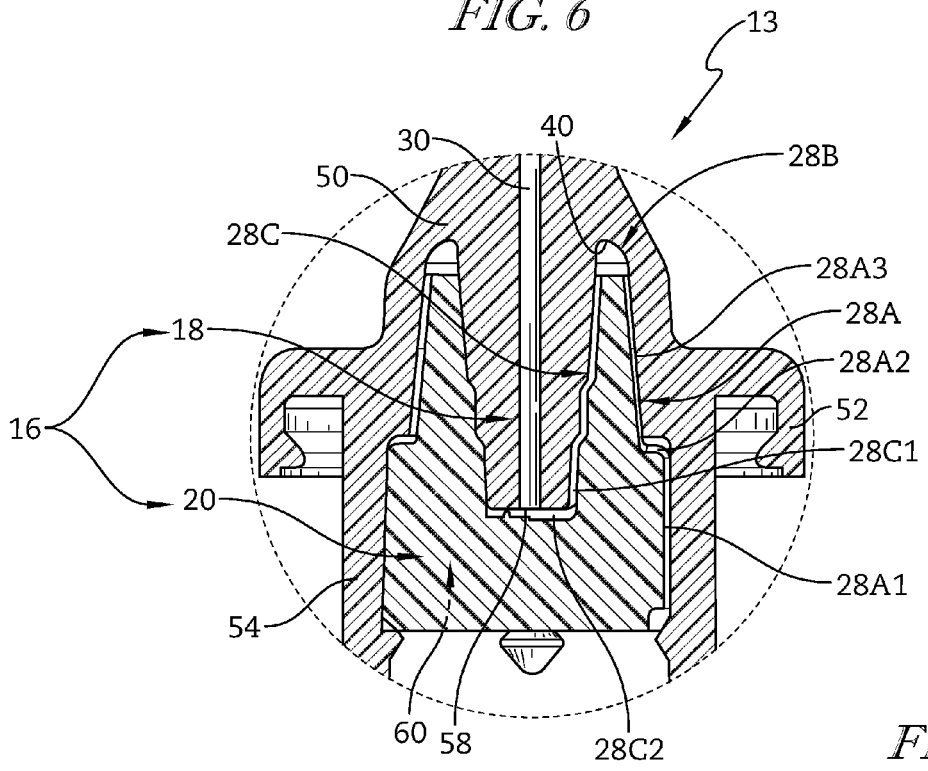
FIG. 7 is an enlarged view taken from the circled region of FIG. 6.
Figure 8:
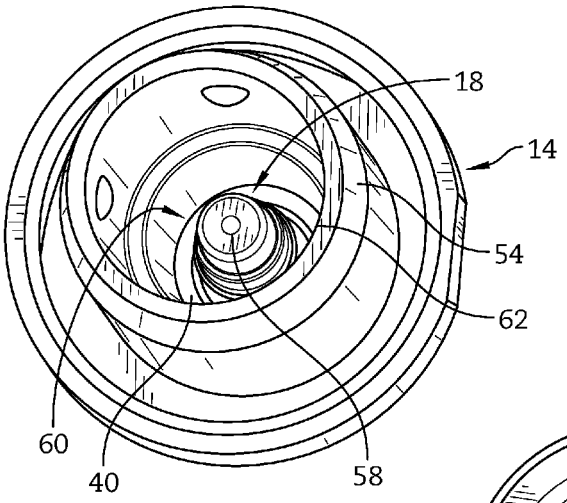
FIG. 8 is a perspective view of the lid and male control unit taken from a bottom of the lid showing the female control-unit retainers and the male control unit.

Male control unit 18, female control unit 20, and lid 14 cooperate to define a flow-control passageway 28 therebetween as shown in FIGS. 2, 6, and 7. Flow-control passageway 28 is in fluid communication with interior product-storage region 22 and droplet passageway 30 formed in lid 14 and male control unit 18. During use of package 10, a user applies a force to container 12 to apply pressure to fluid stored in interior product-storage region 22 to cause the fluid to move from interior product-storage region 22 through flow-control passageway 28, and into droplet passageway 30.

Flow-control passageway 28 includes in series from interior product-storage region 22 to droplet passageway 30, an outer section 28A, a damping chamber 28B, and an inner section 28C as shown in FIGS. 2, 6, and 7. Outer section 28A is adapted to cause the fluid to move in a downstream direction 34 away from container 12 as shown in FIG. 2. Outer section 28A is defined by female control unit 20 and lid 14. Damping chamber 28B is adapted to cause the fluid to flow in an inward direction 36 toward a longitudinal axis 38 of closure 13 as shown in FIG. 2. Damping chamber is defined by lid 14, male control unit 18, and female control unit 20. Inner section 28C is adapted to cause the fluid to flow in an upstream direction 42 toward container 12 and inward direction 36 toward longitudinal axis 38 and droplet passageway 30 as shown in FIG. 2. Inner section 28C is defined by male control unit 18 and female control unit 20.

Outer section 28A of flow-control passageway 28 includes a first outer portion 28A1, a second outer portion 28A2, and a third outer portion 28A3 as shown in FIGS. 2, 6, and 7. First outer portion 28A1 is arranged to extend in downstream direction 34. Second outer portion 28A2 is arranged to extend in inward direction 36 toward longitudinal axis 38. Third outer portion 28A3 is arranged to extend in downstream direction 34.

Damping chamber 28B is defined by an annular concave surface 40, a portion of male control unit 18, and a portion of female control unit 20 as shown in FIGS. 2, 6, and 7. Annular concave surface 40 is included in lid 14 and arranged to face toward female control unit 20 and the portion of male control unit 18. Damping chamber 28B is ring shaped and has a volume relatively greater than a volume of inner section 28C and outer section 28A, whether taken alone or together.

Inner section 28C of flow-control passageway 28 includes a first inner portion 28C1 and a second inner portion 28C2 as shown in FIGS. 2, 6, and 7. First inner portion 28C1 is arranged to extend in upstream direction 42 toward container 12. Second inner portion 28C2 is arranged to extend toward longitudinal axis 38 and be in communication with droplet passageway 30 as suggested in FIG. 2.

Figure 9:
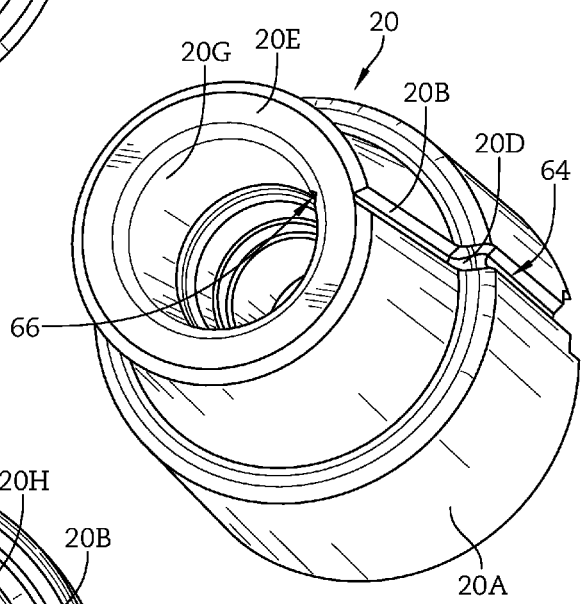
FIG. 9 is a perspective view of a the female control unit of FIGS. 1-7 showing that the female control unit is formed to include an outer flow-control trench and an inner flow control trench.
Figure 10:
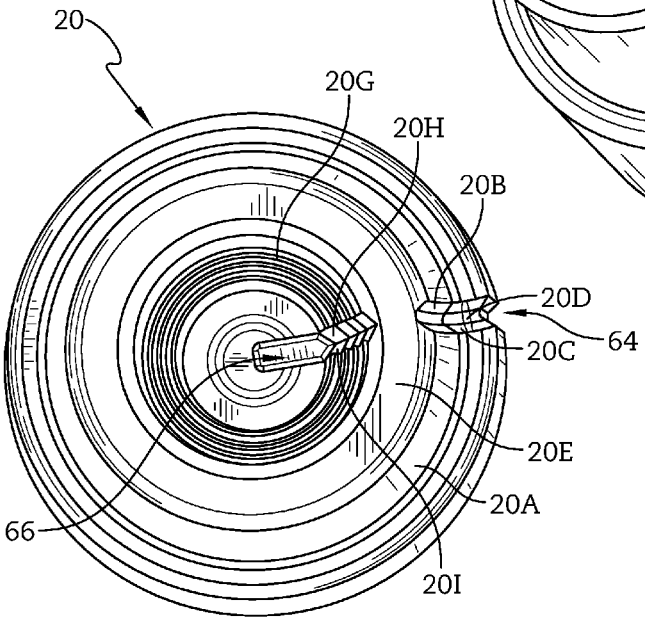
FIG. 10 is a plan view of the female control unit of FIG. 9 showing the outer and inner flow-control trenches.

Female control unit 20 includes an outer surface 20A, a first outer passageway surface 20B, a second outer passageway surface 20C, and a third outer passageway surface 20D as shown in FIGS. 9 and 10. Outer surface 20A is arranged to face away from male control unit 18 toward lid 14. First outer passageway surface 20B arranged to extend from the outer surface 20A toward longitudinal axis 38. Second outer passageway surface 20C is arranged to extend away from outer surface 20A toward longitudinal axis 38. Third outer passageway surface 20D is arranged to extend between and interconnect first and second outer passageway surfaces 20B, 20C as shown in FIGS. 9 and 10. Third outer passageway surface 20D is arranged to lie in spaced-apart radial relation between outer surface 20A of female control unit 20 and longitudinal axis 38. Together, first, second, and third outer passageway surfaces 20B, 20C, 20D cooperate to establish an outer flow-control trench 64.

Figure 4:
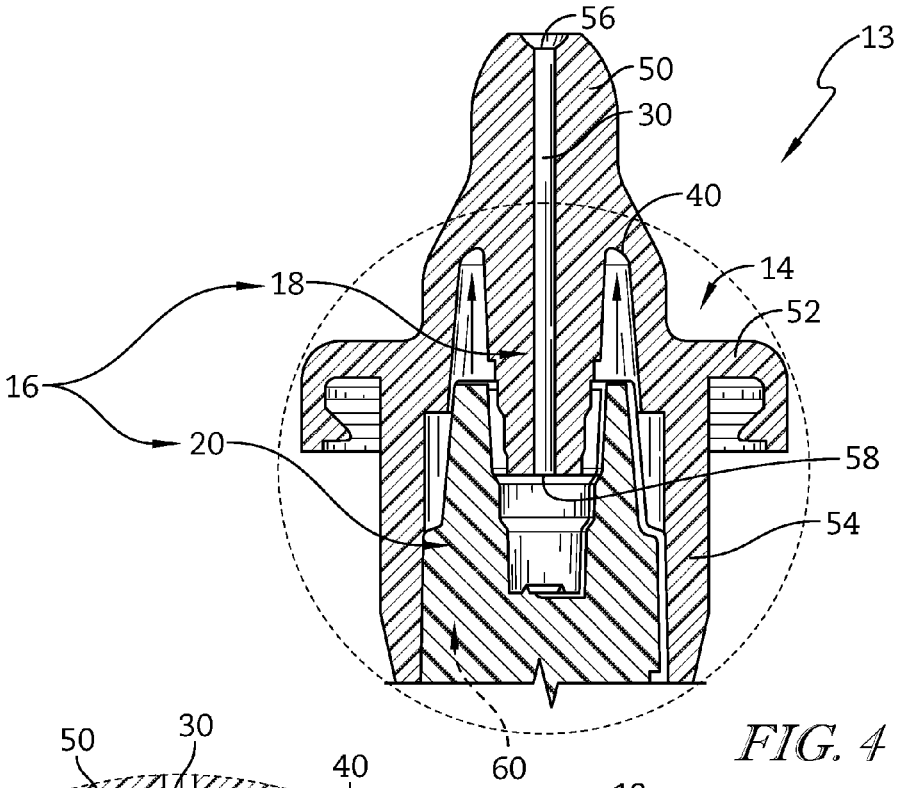
FIG. 4 is an enlarged elevation view with portions broken away revealing the female control unit in spaced-apart relation to the male control unit during assembly of the closure suggesting the flow-control passageway is defined between the female control unit and the lid and the male control unit.
Figure 5:
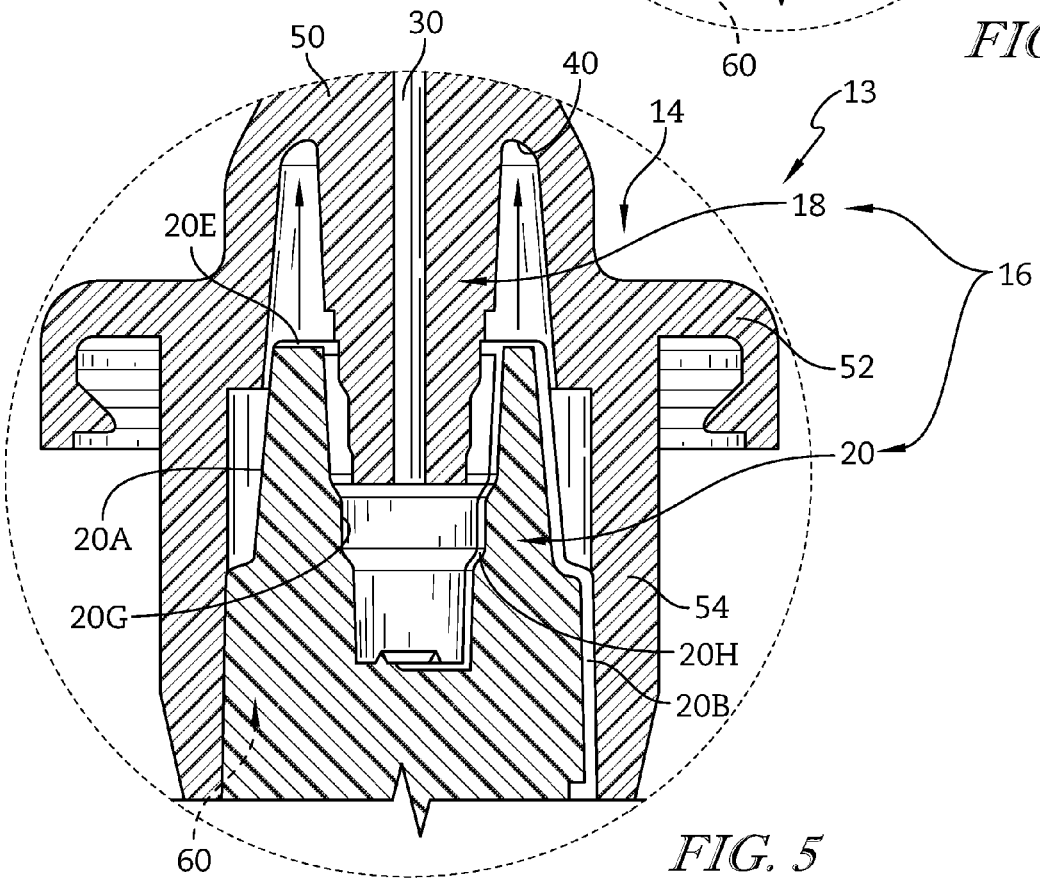
FIG. 5 is an enlarged view taken from the circled region of FIG. 4.

Female control unit 20 further includes an upper surface 20E and a lower surface 20F as shown in FIGS. 4 and 5. Upper surface 20E is arranged to face in an upward direction 44 opposite downward direction 26. Lower surface 20F is arranged to face in downward direction 26 toward container 12. Female control unit 20 exists between upper surface 20E and lower surface 20F as shown in FIGS. 4 and 5. Upper surface 20E provides the portion of female control unit 20 that cooperates with other components to define damping chamber 28B.

Female control unit 20 further includes an inner surface 20G, a first inner passageway surface 20H, and a second inner passageway surface 20I as shown in FIG. 10. Inner surface 20G is arranged to face toward male control unit 18. First inner passageway surface 20H is arranged to extend from inner surface 20G away from longitudinal axis 38 toward outer surface 20A. Second inner passageway surface 20I is arranged to extend from inner surface 20G away from longitudinal axis 38 toward outer surface 20A. First and second inner passageway surfaces 20H, 20I extend toward one another and terminate where first and second inner passageway surfaces 20H, 20I intersect one another as shown in FIG. 10. Together, first and second inner passageway surfaces 20H, 20I cooperate to establish an inner flow-control trench 66.

Container 12 includes a body 46 formed to include interior product-storage region 22 and neck 24 coupled to body 46 and formed to include a mouth 48 arranged to open into interior product-storage region 22. Lid 14 is coupled to container 12 and includes a nozzle 50, a nozzle mount 52, and a droplet-controller receiver 54 as shown in FIG. 2. Nozzle mount 52 is coupled selectively to neck 24 of body 46. Nozzle 50 is coupled to nozzle mount 52 and arranged to extend upwardly away from container 12 as shown in FIG. 1. Droplet-controller receiver 54 is arranged to extend downwardly away from nozzle 50 and nozzle mount 52 through mouth 48 and into interior product-storage region 22 of container 12 as shown in FIG. 2.

Nozzle 50 is formed to include droplet passageway 30 arranged to extend along longitudinal axis 38 of package 10. Nozzle 50 is further formed to include an outlet aperture 56 and an inlet aperture 58. Outlet aperture 56 is arranged to open into droplet passageway 30 and be located in spaced apart relation to container 12 and droplet controller 16. Inlet aperture 58 is arranged to open into droplet passageway 30 and be in communication with second inner portion 28C2 of inner section 28C of flow-control passageway 28 as shown in FIG. 2.

Droplet-controller receiver 54 is formed to include a droplet-controller space 60 and a controller-receiving aperture 62 arranged to open into droplet-controller space 60. Droplet controller 16 is located in droplet-controller space 60 and coupled to droplet-controller receiver 54 to move therewith and relative thereto.

Figure 11:
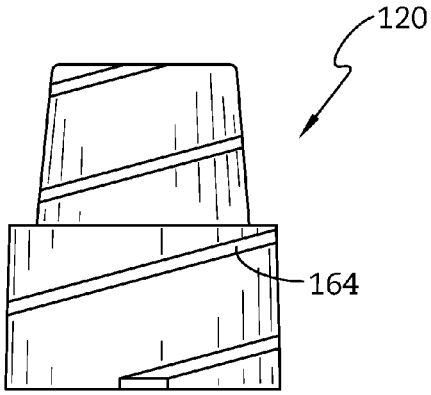
FIG. 11 is an elevation view of a second embodiment of a female control unit in accordance with the present disclosure.

A second embodiment of a female control unit 120 in accordance with the present disclosure is shown in FIG. 11. Female control unit 120 is formed to include an outer flow-control trench 164 as shown in FIG. 11. Outer flow-control trench 164 has a helical shape that extends around a circumference of female control unit 120 while moving from the lower surface to the upper surface. Outer flow-control trench 164 may have any suitable number of revolutions.

Figure 12:
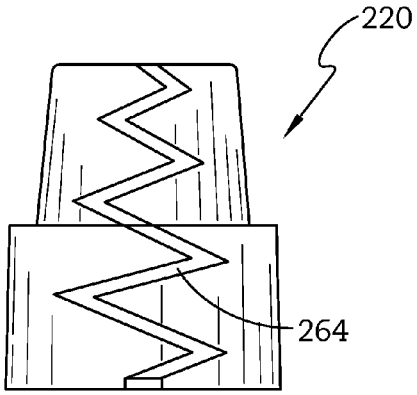
FIG. 12 is an elevation view of a second embodiment of a female control unit in accordance with the present disclosure.

A third embodiment of a female control unit 220 in accordance with the present disclosure is shown in FIG. 12. Female control unit 220 is formed to include an outer flow-control trench 264 as shown in FIG. 12. Outer flow-control trench 264 has a zig-zag shape that extends between the lower surface and the upper surface. Outer flow-control trench 264 may have any suitable number of changes in direction.

Figure 13:
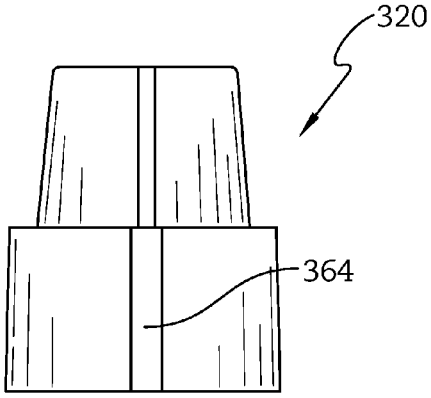
FIG. 13 is an elevation view of a third embodiment of a female control unit in accordance with the present disclosure.

A fourth embodiment of a female control unit 320 in accordance with the present disclosure is shown in FIG. 13. Female control unit 320 is formed to include an outer flow-control trench 364 as shown in FIG. 13. Outer flow-control trench 364 has a relatively straight shape that extends between the lower surface and the upper surface. Outer flow-control trench 364 has a lower section having a relatively greater width than an upper section. The relative widths of the upper and lower sections may be varied.

Figure 14:
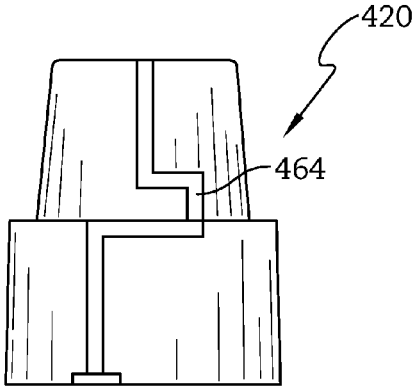
FIG. 14 is an elevation view of a fourth embodiment of a female control unit in accordance with the present disclosure.

A fifth embodiment of a female control unit 420 in accordance with the present disclosure is shown in FIG. 14. Female control unit 420 is formed to include an outer flow-control trench 464 as shown in FIG. 14. Outer flow-control trench 464 has a shape comprised of several different substantially vertical portions and horizontal portions. The number of vertical portions and horizontal portions along with their relative lengths may be varied.

Figure 15:
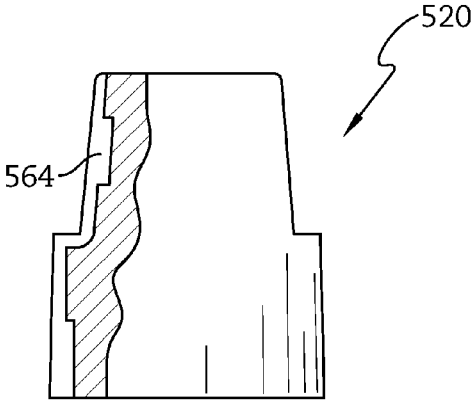
FIG. 15 is an elevation view of a fifth embodiment of a female control unit in accordance with the present disclosure.

A sixth embodiment of a female control unit 520 in accordance with the present disclosure is shown in FIG. 15. Female control unit 520 is formed to include an outer flow-control trench 564 as shown in FIG. 15. Outer flow-control trench 564 has several different sections with varying depth into female control unit 520. The number and depth of the sections may be varied.

Figure 16:
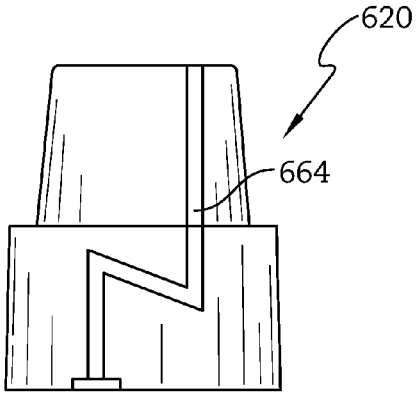
FIG. 16 is an elevation view of a sixth embodiment of a female control unit in accordance with the present disclosure.

A seventh embodiment of a female control unit 620 in accordance with the present disclosure is shown in FIG. 16. Female control unit 620 is formed to include an outer flow-control trench 664 as shown in FIG. 16. Outer flow-control trench 664 has at least one section which flows in the upstream direction before returning to a subsequent section that flows in the downstream direction. The number of sections flowing in the upstream direction may be varied.

The various female control units 20, 120, 220, 320, 420, 520, 620 include various concepts of shapes of flow control-trenches that may combined in any suitable combination. Furthermore, the concepts shown in the outer flow-control trenches of female control units 20, 120, 220, 320, 420, 520, 620 may also be used in any suitable combination for inner flow-control trenches.

The present disclosure relates to a valveless liquid dispensing dropper 10 which may be used for controlled medicine deliver with user independent for variation in squeeze force and orientation. As a result, medicine delivery precision and consistency is maximized.

The liquid dispenser comprises of a dispensing nozzle provided with a longitudinal channel liquid outlet and an insert, also called flow reducing component, defining flow reducing channels on its outer and inner periphery for longitudinal flow reduction. However, these restriction channels can be varied depending on the viscosity of the liquid. In order to increase the flow rate of the liquid and reduce the risk of deposition in the channel, it is necessary to increase the width of the restriction channel on the flow reducing insert. Another solution may be to vary the length of the restriction channel. However, realization of the channel's small passage section rate reduction is particularly difficult for mass production, particularly when these flow limiting channels have a considerable length.

The present disclosure is intended to provide a dispenser for simple liquid product to perform and allow better control of the distribution, including minimizing the jetting risk through the dispensing nozzle, particularly in case of rapid variation of pressure of the liquid product during squeezing of the package by the user.

The disclosure relates to a liquid product dispenser, comprising a dispensing nozzle having a cavity and a longitudinal channel outlet, a flow reducing insert, also called female control unit 20, located in a cavity surrounding a protrusion, also called male control unit 18. The liquid product dispenser further comprising at least two flow restrictor channels defined by the body of the speed reduction insert and dispensing nozzle. Each flow restrictor channel having at least one cross section to the flow direction of the liquid product in the flow reducing channel and at least one damping chamber delimited by the flow reducing insert and the dispensing nozzle. The flow reducing channels being interconnected by the damping chamber and this damping chamber having a cross section at flow direction of the liquid which is of at least three times greater than the flow reducing channel section. Dispensing of fluid stored in the container is relatively uniform and better controlled as a result of the at least one damping chamber and two flow reducing channels.

The damping chamber has a greater cross section than the cross section of the flow reducing channels, generating a loss of pressure and deflection of the dispensed liquid product, it absorbs any sudden variation in the pressure of the liquid product, which enables a better control. The risk of dispensing the liquid product in a stream, rather than by a droplet, is minimized. Furthermore, the relative flow resistance presented by the flow reducing channels avoids or minimizes unintended delivery of product due to gravity if the dispenser is positioned upside down. Simplicity of design is minimized as a result of the number of components being minimized and the omission of a check valve.

Flow reducing channels and the damping chamber are bounded by the dispensing nozzle and grooves formed on a wall of the flow reducing insert. Thus, the orifice may used to dispense uniform drops. Flow reducing channels may be adapted according to the type of liquid that is to be dispensed. As a result, manufacturing is simplified while flexibility of use with various liquids is maximized.

In one example, at least one flow restrictor channel, also called a section of a flow-control passageway, is not rectilinear. This allows the deflection of the liquid product and therefore creating additional pressure loss. The non-straight part of the at least one reduction of channel flow may occur at one or more times in the path taken by the liquid product in the flow reducing channels. In one example, the flow reducing channel is not straight and the liquid product is subjected to a change of direction in the same flow reducing channel. The liquid product in flowing from the container to the droplet passageway makes two, four, or more turns in direction (e.g, upstream, downstream). These changes in direction cause additional pressure loss in the system for better control in distribution of the liquid product.

In another example, the flow reducing insert is non-porous. The non-porous nature of the flow reducing insert means that the liquid product cannot pass through the walls of the dispensing nozzle body. Therefore, the liquid product is forced to pass through the flow reduction channel. Furthermore, the walls of the flow reducing insert are sufficiently strong so as to resist deformation by the pressure of the liquid product. The liquid under pressure follows the flow reducing channel passing successively by the first flow reducing channel, the damping chamber, the second flow restrictor channel and the longitudinal channel, also called droplet passageway. As a result, the liquid product is forced to pass between the dispensing nozzle and flow reducing insert.

In one example, the flow reducing insert is molded from a low density polymer like Low Density Polyethylene (LDPE) or any other suitable material. This type of material makes the process and assembly of the flow reducing insert into the dispensing nozzle easier. Moreover, this material is relatively deformable, allowing a relatively wide margin of manufacturing tolerance.

The dispenser includes a longitudinal channel and the damping chamber which defines a volume of revolution with respect to longitudinal axis. It is understood that volume of revolution with respect to the longitudinal axis corresponds to a volume generated by the rotation of a predetermined section around the longitudinal axis of the dispenser. Whereas, the reduction in flow channels are generally uniformly distributed around the longitudinal axis of the dispenser, with a cross-section relatively small, for example through the grooves bound by the flow reducing insert. The damping chamber has a cross section relatively large and is annular in shape. In other words, the damping chamber has a volume and a relatively large section when compared to those of the channels of flow reducing channel it is connected to. This allows it to dampen pressure fluctuations, particularly pressure increases since the liquid tends to fill the entire damping chamber, before engaging in the following flow reduction channels. The proposed dispenser thus limits the risk of jet formation. The damping chamber has a volume defined on one side by an end wall of the flow reducing insert having in particular the form of a hollow disc and extending in a plane substantially transverse (lying across) to the longitudinal axis of the dispenser and the other by an internal throat portion of the dispensing nozzle, this groove being delimited on one side by the inner central protrusion and the other side by an outer skirt of the dispensing nozzle.

With this configuration, in the position of use, the dispenser is tilted so that the dispensing nozzle is upside down relative to a generally deformable reservoir containing the liquid product. The liquid present in the reservoir is thus in contact with the dispensing nozzle and the flow reducing insert. In doing so and under the pressure effect applied by the user to deform the reservoir, the liquid product after the first channel rate reduction, flows down to arrive in the damping chamber. Once liquid fills in damping chamber, the liquid product takes a second direction substantially opposite to the first direction, upwards in the second flow restrictor channel. Finally, the liquid product flows back down in the longitudinal channel from the tip.

When dispensing the liquid product, the passage of this change of direction liquid product must meet the damping chamber before continuing its path in the second flow restrictor channel. The liquid product, reaches the longitudinal outlet channel, thus loses speed significantly and any sudden change in pressure applied by the user to the container is damped, thus minimizing the formation of a jet of liquid product from the dispensing nozzle.

One embodiment of closure includes a dispensing nozzle and a flow reducing insert coupled to dispensing nozzle. The closure is designed to be placed on a neck of a container so that a liquid product stored in a container is supplied through an orifice of distribution. The liquid product is forced to pass only at the end of the race by a longitudinal channel output leading to the opening and delimited by the forming end of dispensing nozzle. The dispenser allows dispensing of liquids.

In one example, the dispensing nozzle is molded in one piece having a general shape with symmetry of revolution along longitudinal axis. Dispensing nozzle in its inside defines an arranged reservoir, a cavity, which is intended to be attached to body of flow reducing insert. The cavity includes within it a protrusion (inner core) through which the output of longitudinal channel outlet and extending towards container and having a generally conical shape. The flow reducing insert is intended to be mounted around the protrusion. This protrusion is composed with several truncated cones superposed coaxial along longitudinal axis. Thus, the base of the protrusion located towards the top of the dispensing nozzle includes a cone whose base has the largest diameter, the following truncated cones extending toward container has relatively smaller diameter. The junctions between the cones provide shoulders.

The dispensing nozzle comprises, in its upper part, the nozzle distribution, which is extended downward by a body, which is annular in shape, extending around and beyond the protrusion and the portion defining bottom of the dispensing nozzle. The body is configured to be inserted inside the neck of the reservoir, the outer wall engaging surface with the inner wall of the neck of the reservoir. The dispensing nozzle is also provided with an outer skirt of attachment, specifically latching on the neck of the container. This outer skirt defines an outer groove periphery of the body, which is snapped around a bead formed on the upper end of collar. The body comprises in this embodiment at least one of the bead protruding from the inner surface of the body. In one example, the at least one bead is four ribs. The beads 26 are divided inside body, so as to form a discontinuous ring and, to let the liquid between the dispensing nozzle and the flow reducing insert. The beads are configured to cooperate with a surface, the flow reducing insert. In another example, the beads may be replaced by a discontinuous annular groove, or ridges or the groove may be formed on the flow reducing insert.

The dispensing nozzle also comprises an annular groove disposed around the protrusion. This annular groove is bounded on one hand by the protrusion which forms the inner wall of the annular groove and secondly by the junction between the lower parts of the nozzle and the upper part of the body. The bottom of the annular groove partially defines a damping chamber.

The flow reducing insert may be molded from a low density polymer like LDPE or any other suitable material. This material may be the same as that used for the dispensing nozzle. The flow reducing insert may be non-porous. In one example, flow reducing insert is a symmetrical body of revolution with its axis coincides with the longitudinal axis of the dispenser once inserted into the dispensing nozzle. The flow reducing insert has an outer shape similar to that of a cylinder. It includes a lower portion that is generally cylindrical shape and an upper portion having the form exterior of a truncated cone having a longitudinal axis. The flow reducing insert has, in its center, a cavity having a substantially complementary to that of the protrusion, so as to be inserted within the annular groove. The inner surface of the flow reducing insert, which defines the cavity, is provided with recesses forming annular shoulders that are complementary to the shoulders formed on the protrusion.

The upper surface of the flow reducing insert is a substantially flat surface and shape recessed disc so as to conform with the dispensing nozzle and the damping chamber. More specifically, the dispensing nozzle and the flow reducing insert are configured so that the damping chamber defines a volume of revolution about the longitudinal axis. In one example, the damping chamber is annular and has a substantially toroidal section.

The flow reducing insert includes on its outer wall grooves for delimiting, with the dispensing nozzle, two flow reducing channels intended to be connected by the damping chamber when the flow reducing insert is mounted on the dispensing nozzle. In one example, the flow reducing channels are not straight. In another example, the flow reducing channels each comprise several sections. The speed reduction channel is includes three sections each being rectilinear in a direction which varies from one section to the other so as to generate liquid loads. Similarly, the channel rate reduction includes of three sections. The sections of the flow reducing channels are defined by the particular shoulders. In this example, one section has a cross section to the flow direction of the liquid slightly greater than that of the other sections. The flow reducing insert further comprises, at the bottom of the cavity, a channel, radially connected to the flow restrictor channel to the longitudinal output channel 16.

When the speed reducing insert is assembled with dispensing nozzle, the damping chamber has a cross section at least three times greater than the section of the flow reducing channels. As the damping chamber is generally toroidal, the liquid product flows in the damping chamber in a transverse plane of the dispenser so that the cross section of the damping chamber is the section visible in FIG. 2. In contrast, in the flow reducing channels, the liquid product flows in a relatively parallel to the longitudinal axis given the vertical configuration of the sections. The channels cross-sections are more than three times smaller than that of the damping chamber.

The flow reducing insert and the dispensing nozzle may be sized such that the surface contacts do not let the liquid product out of dispenser. In other words, the contact between the dispensing nozzle and the flow reducing insert provides a seal due to the surface tension of the fluid. As a result, the liquid product may only escape through the flow reducing channels when the user turns the flow reducing dispenser upside down and deformed by the reservoir pressure. The product liquid then begins to flow between the flow reducing insert and the tip of dispensing nozzle.

The liquid product may have some speed given the pressure exerted by the user and the low section reduction in flow channel. Once the fluid reaches the damping chamber, the liquid product is distributed throughout the annular volume causing turbulence in the flow and thus a speed loss so that the flow velocity in the flow restriction channel that follows is less and that the jets will be minimized.

In one example, at least one of the flow reducing dispenser may optionally comprise two successive sections connected by a similar damping chamber to the damping chamber the damping chamber shown in FIG. 2. For example in reference to the flow reducing dispenser, it would be possible to provide a damping chamber in place of one or more of the sections. The damping chamber would be a ring which would be added to the damping chamber to further limit jet generation. The other damping chamber also has a section transverse to the flow of the liquid in the original damping chamber at least three times greater than the lengths of the section of the flow restrictor channel it connects.

The flow reducing dispenser may of course take other configurations than presented above. In particular it is possible to incorporate grooves on the inner and outer surfaces of the flow reducing insert, on the protrusion, or on the main skirt thus forming other forms of flow reducing canals for the passage of liquid. The flow reducing dispenser may include two sets of flow reduction channels, three, four, or more distributed around the longitudinal axis. This can particularly help the distribution of more viscous liquids.

In one example, a dispenser for dispensing liquid product is comprised of a dispensing nozzle having a cavity and a channel longitudinal outlet of the liquid product. The cavity is comprised of a protrusion traversed by the inner central longitudinal outlet channel, a flow reducing insert attached around the protrusion, at-least two flow reducing channel sections that are delimited by the flow reducing insert and the dispensing nozzle. Each flow reducing channel section has at least one cross section to the flow direction of the product into the product flow reducing channel section. The dispenser is comprised of at least one damping chamber comprised of a flow reducing insert and the dispensing nozzle. In an example, the flow reducing channel sections are interconnected by the damping chamber. The damping chamber has a section transverse to the direction of liquid flow in the damping chamber which is at least three times greater than the flow reducing channel section.

In one example, the flow reducing channel section and the damping chamber are defined by the dispensing nozzle and grooves formed on a wall of the flow reducing insert. In another example, at least one of the flow reducing passages is non-rectilinear. At least one of the flow reducing channel sections comprises several different cross-sections, for example two sections.

In one example, the flow reducing insert is nonporous. In another example, the flow reducing insert is made of a low density polymer. In yet another example, the flow reducing insert if made of LDPE.

The dispenser comprises a longitudinal axis and the damping chamber defines a volume of revolution about said longitudinal axis. In one example, the cavity comprises a base partially defining the damping chamber. In another example, at least one of flow restriction channel sections comprises at least two sections successive interconnected via a damping channel. In yet another example, the cavity is delimited by a main skirt which is comprised of at least one bead or a groove cooperating with a surface of the flow reducing insert for securing the insert in the cavity.

In an example, the liquid dispenser is comprised of a dispensing nozzle having a cavity provided with a protrusion through a longitudinal outlet channel of the liquid, a flow reducing insert fitted around the protrusion, two flow reducing passages delimited by the body of the flow reducing insert, and the dispensing nozzle, each having a cross section to the direction of flow in the channel. The damping chamber is delimited by the flow reducing insert and the dispensing nozzle. The flow reducing passages are interconnected by the damping chamber and the damping chamber has a cross section flow direction of the liquid in the chamber at least three times greater than the section of the flow restrictor channel.

The following numbered clauses include embodiments that are contemplated and non-limiting:

Clause 1. A package comprising a container including a body formed to include an interior product-storage region and neck coupled to the body and formed to include a mouth opening into the interior-product storage region, a lid coupled the neck of the container and formed to include a portion of a droplet passageway therein which is arranged to extend along a longitudinal axis of the lid, the droplet passageway being adapted to communicate a droplet of fluid from the interior region to environment surrounding the package, and a droplet controller coupled to the lid to move therewith and configured to provide means for controlling discharge of the droplet of fluid stored in the interior region in response to pressurization of the fluid in the interior region so that a pre-determined size of the droplet and a predetermined rate of discharging the droplet occurs when the package is in any orientation and pressure is applied to the fluid stored in the interior product-storage region.

Clause 2. A closure comprising a lid adapted to couple to a neck of a container and formed to include a portion of a droplet passageway therein which is arranged to extend along a longitudinal axis of the lid and a droplet controller coupled to the lid to move therewith and configured to control discharge of the droplet of fluid stored in an interior product-storage region of the container in response to pressurization of the fluid in the interior region so that a pre-determined size of the droplet and a predetermined rate of discharging the droplet occurs when the closure is in any orientation and pressure is applied to the fluid stored in the interior product-storage region.

Clause 3. The package of any other clause or combination of clauses, wherein the droplet controller includes a male control unit coupled to the lid in a fixed position relative to the lid.

Clause 4. The package of any other clause or combination of clauses, wherein the male control unit is arranged to extend in a downward direction away from the lid toward the container along the longitudinal axis.

Clause 5. The package of any other clause or combination of clauses, wherein the droplet controller further includes a female control unit coupled to the lid and arranged to lie in spaced-apart relationship to the male control unit to locate the female control unit between the male control unit and the container.

Clause 6. The package of any other clause or combination of clauses, wherein the male control unit, female control unit, and the lid cooperate to define a flow-control passageway therebetween.

Clause 7. The package of any other clause or combination of clauses, wherein the flow-control passageway is in fluid communication with the interior product-storage region and the droplet passageway.

Clause 8. The package of any other clause or combination of clauses, wherein the flow-control passageway includes, in series from the interior product-storage region to the droplet passageway, an outer section adapted to cause the fluid to move in a downstream direction away from the container.

Clause 9. The package of any other clause or combination of clauses, wherein the flow-control passageway further includes a damping chamber adapted to cause the fluid to flow in an inward direction toward the longitudinal axis.

Clause 10. The package of any other clause or combination of clauses, wherein the flow-control passageway further includes an inner section adapted to cause the fluid to flow in an upstream direction toward the container.

Clause 11. The package of any other clause or combination of clauses, wherein the outer section of the flow-control passageway includes a first outer portion arranged to extend in the downstream direction.

Clause 12. The package of any other clause or combination of clauses, wherein the outer section of the flow-control passageway further includes a second outer portion arranged to extend in the inward direction toward the longitudinal axis.

Clause 13. The package of any other clause or combination of clauses, wherein the outer section of the flow-control passageway further includes a third outer portion arranged to extend in the downstream direction.

Clause 14. The package of any other clause or combination of clauses, wherein the damping chamber is defined in part an annular concave surface included in the lid.

Clause 15. The package of any other clause or combination of clauses, wherein the annular concave surface is arranged to face toward the female control unit.

Clause 16. The package of any other clause or combination of clauses, wherein the damping chamber is defined in part by a portion of the male control unit.

Clause 17. The package of any other clause or combination of clauses, wherein the inner section of the flow-control passageway includes a first inner section arranged to extend in the upstream direction toward container.

Clause 18. The package of any other clause or combination of clauses, wherein the inner section of the flow-control passageway further includes a second inner section arranged to extend toward the longitudinal axis and be in communication with the droplet passageway.

Clause 19. The package of any other clause or combination of clauses, wherein the outer section of the flow-control passageway includes a first outer portion arranged to extend in the downstream direction, a second outer portion arranged to extend in the inward direction toward the longitudinal axis, and a third outer portion arranged to extend in the downstream direction, the damping chamber is defined by an annular concave surface included in the lid and arranged to face toward the male control unit and a portion of the male control unit, and the inner section of the flow-control passageway includes a first inner section arranged to extend in the upstream direction toward container and a second inner section arranged to extend toward the longitudinal axis and be in communication with the droplet passageway.

Clause 20. The package of any other clause or combination of clauses, wherein the droplet controller and the lid cooperate to define a flow-control passageway therebetween and the flow-control passageway is in fluid communication with the interior product-storage region and the droplet passageway.

Clause 21. The package of any other clause or combination of clauses, wherein the flow-control passageway includes, in series from the interior product-storage region to the droplet passageway, an outer section, a damping chamber, and an inner section.

Clause 22. The package of any other clause or combination of clauses, wherein the outer section is adapted to cause the fluid to move in a downstream direction away from the container.

Clause 23. The package of any other clause or combination of clauses, wherein the damping chamber is adapted to cause the fluid to flow in an inward direction toward the longitudinal axis.

Clause 24. The package of any other clause or combination of clauses, wherein the inner section is adapted to cause the fluid to flow in an upstream direction toward the container.

Clause 25. The package of any other clause or combination of clauses, wherein the outer section of the flow-control passageway includes a first outer portion, a second outer portion, and a third outer portion.

Clause 26. The package of any other clause or combination of clauses, wherein the first outer portion is arranged to extend in the downstream direction.

Clause 27. The package of any other clause or combination of clauses, wherein the second outer portion arranged to extend in the inward direction toward the longitudinal axis.

Clause 28. The package of any other clause or combination of clauses, wherein the third outer portion is arranged to extend in the downstream direction.

Clause 29. The package of any other clause or combination of clauses, wherein the droplet controller includes a male control unit.

Clause 30. The package of any other clause or combination of clauses, wherein the male control unit is coupled to the lid.

Clause 31. The package of any other clause or combination of clauses, wherein the male control unit is coupled to the lid in a fixed position relative to the lid.

Clause 32. The package of any other clause or combination of clauses, wherein the male control unit is arranged to extend in a downward direction away from the lid toward the container along the longitudinal axis.

Clause 33. The package of any other clause or combination of clauses, wherein the droplet controller further includes a female control unit coupled to the lid.

Clause 34. The package of any other clause or combination of clauses, wherein the female control unit is arranged to lie in spaced-apart relationship to the male control unit.

Clause 35. The package of any other clause or combination of clauses, wherein the female control unit is located between the male control unit and the container.

Clause 36. The package of any other clause or combination of clauses, wherein the outer section of the flow-control passageway is defined by the male control unit and the lid.

Clause 37. The package of any other clause or combination of clauses, wherein the damping chamber is defined, in part, by the female control unit.

Clause 38. The package of any other clause or combination of clauses, wherein the damping chamber is defined, in part, by the male control unit.

Clause 39. The package of any other clause or combination of clauses, wherein the damping chamber is defined, in part, by a surface included in the lid.

Clause 40. The package of any other clause or combination of clauses, wherein the surface is annular.

Clause 41. The package of any other clause or combination of clauses, wherein the surface is concave.

Clause 42. The package of any other clause or combination of clauses, wherein the surface is arranged to face toward the male control unit.

Clause 43. The package of any other clause or combination of clauses, wherein the inner section of the flow-control passageway is defined, in part, by the male control unit.

Clause 44. The package of any other clause or combination of clauses, wherein the inner section of the flow-control passageway is defined, in part, by the female control unit.

Clause 45. The package of any other clause or combination of clauses, wherein the damping chamber is defined by the female control unit, the male control unit, and an annular concave surface included in the lid and arranged to face toward the male control unit.

Clause 46. The package of any other clause or combination of clauses, wherein the inner section of the flow-control passageway is defined by the male control unit and the female control unit.

Clause 47. The package of any other clause or combination of clauses, wherein the female control unit includes an outer surface arranged to face away from the male control unit toward the lid.

Clause 48. The package of any other clause or combination of clauses, wherein the female control unit further includes a first outer passageway surface arranged to extend from the outer surface toward the longitudinal axis.

Clause 49. The package of any other clause or combination of clauses, wherein the female control unit further includes a second outer passageway surface arranged to extend away from the outer surface toward the longitudinal axis.

Clause 50. The package of any other clause or combination of clauses, wherein the female control unit further includes a third outer passageway surface arranged to extend between and interconnect the first and second outer passageway surfaces.

Clause 51. The package of any other clause or combination of clauses, wherein the third outer passageway is arranged to lie in spaced-apart radial relation between the outer surface of the female control unit and the longitudinal axis.

Clause 52. The package of any other clause or combination of clauses, wherein the female control unit further includes an upper surface arranged to face in an upward direction opposite the downward direction.

Clause 53. The package of any other clause or combination of clauses, wherein the female control unit further includes a lower surface arranged to face in the downward direction toward the container and the female control unit is located between the upper and lower surfaces.

Clause 54. The package of any other clause or combination of clauses, wherein the female control unit further includes an inner surface arranged to face toward the male control unit.

Clause 55. The package of any other clause or combination of clauses, wherein the female control unit further includes a first inner passageway surface arranged to extend from the inner surface away from the longitudinal axis toward the outer surface.

Clause 56. The package of any other clause or combination of clauses, wherein the female control unit further includes a second inner passageway surface arranged to extend from the inner surface away from the longitudinal axis toward the outer surface.

Clause 57. The package of any other clause or combination of clauses, wherein the first and second inner passageway surfaces extend toward one another.

Clause 58. The package of any other clause or combination of clauses, wherein the first and second inner passageway surface terminate where the first and second inner passageway surfaces intersect one another.

Clause 59. The package of any other clause or combination of clauses, wherein the inner surface of the female control unit includes a first annular band located a first distance from the longitudinal axis.

Clause 60. The package of any other clause or combination of clauses, wherein the inner surface of the female control unit includes a second annular band located a second distance from the longitudinal axis.

Clause 61. The package of any other clause or combination of clauses, wherein the inner surface of the female control unit includes a third annular band located a third distance from the longitudinal axis.

Clause 62. The package of any other clause or combination of clauses, wherein the first distance is greater than the second distance.

Clause 63. The package of any other clause or combination of clauses, wherein the second distance is greater than the third distance.

Clause 64. The package of any other clause or combination of clauses, wherein the third annular band is located between the first annular band and the container.

Clause 65. The package of any other clause or combination of clauses, wherein the second annular band is located between the first and third annular bands.

Clause 66. The package of any other clause or combination of clauses, wherein the inner surface of the female control unit further includes a first transition surface arranged to extend between interconnect the first and second annular bands.

Clause 67. The package of any other clause or combination of clauses, wherein the first transition surface has a frustoconical shape.

Clause 68. The package of any other clause or combination of clauses, wherein the inner surface of the female control unit further includes a second transition surface arranged to extend between and interconnect the second and third annular bands.

Clause 69. The package of any other clause or combination of clauses, wherein the second transition surface has a frustoconical shape.

The invention claimed is:

1. A package comprising:

a container including a body formed to include an interior product-storage region and a neck coupled to the body and formed to include a mouth opening into the interior-product storage region, a lid coupled to the neck of the container and formed to include a portion of a droplet passageway therein which is arrange to extend along a longitudinal axis of the lid, the droplet passageway being adapted to communicate a droplet of fluid from the interior region to an environment surrounding the package, and droplet controller coupled to the lid to move therewith and configured to provide means for controlling discharge of the droplet of fluid stored in the interior region in response to pressurization of the fluid in the interior region so that a pre-determined size of the droplet and a predetermined rate of discharging the droplet occurs when the package is in any orientation and pressure is applied to the fluid stored in the interior product-storage region, wherein the droplet controller includes a male control unit coupled to the lid in a fixed position relative to the lid and arranged to extend in a downward direction away from the lid toward the container along the longitudinal axis and a female control unit coupled to the lid and arranged to lie in a spaced-apart relationship to the male control unit to locate the female control unit between the male control unit and the container, the female control unit having a trench arranged to extend from an outer surface of the female control unit toward the longitudinal axis, the female control unit having an inner surface surrounding the male control unit, wherein each of the male control unit, the female control unit, and the lid cooperate to define a flow-control passageway therebetween, wherein the flow-control passageway includes an outer section, wherein the outer section of the flow-control passageway includes a first outer portion arranged to extend in a downstream direction, a second outer portion arranged to extend in an inward direction toward the longitudinal axis, and a third outer portion arranged to extend in the downstream direction wherein a transition between the second outer portion and at least one of the first outer portion and the third outer portion is curved.

2. The package of claim 1, wherein the flow-control passageway is in fluid communication with the interior product-storage region and the droplet passageway.

3. The package of claim 2, wherein the flow-control passageway includes, in series from the interior product-storage region to the droplet passageway, the outer section adapted to cause the fluid to move in a downstream direction away from the container, a damping chamber adapted to cause the fluid to flow in an inward direction toward the longitudinal axis, and an inner section adapted to cause the fluid to flow in an upstream direction toward the container.

4. The package of claim 3, wherein the damping chamber is defined by an annular concave surface included in the lid and arranged to face toward the female control unit and a portion of the male control unit.

5. The package of claim 3, wherein the inner section of the flow-control passageway includes a first inner section arranged to extend in the upstream direction toward the container and a second inner section arranged to extend toward the longitudinal axis and be in communication with the droplet passageway.

6. The package of claim 3, wherein the outer section of the flow-control passageway includes the first outer portion arranged to extend in the downstream direction, the second outer portion arranged to extend in the inward direction toward the longitudinal axis, and the third outer portion arranged to extend in the downstream direction, the damping chamber is defined by an annular concave surface included in the lid and arranged to face toward the female control unit and a portion of the male control unit, and the inner section of the flow-control passageway includes a first inner section arranged to extend in the upstream direction toward container and a second inner section arranged to extend toward the longitudinal axis and be in communication with the droplet passageway.

7. The package of claim 1, wherein the droplet controller and the lid cooperate to define a flow-control passageway therebetween and the flow-control passageway is in fluid communication with the interior product-storage region and the droplet passageway.

8. The package of claim 7, wherein the flow-control passageway includes, in series from the interior product-storage region to the droplet passageway, an outer section adapted to cause the fluid to move in a downstream direction away from the container, a damping chamber adapted to cause the fluid to flow in an inward direction toward the longitudinal axis, and an inner section adapted to cause the fluid to flow in an upstream direction toward the container.

9. The package of claim 8, wherein the outer section of the flow-control passageway includes a first outer portion arranged to extend in the downstream direction, a second outer portion arranged to extend in the inward direction toward the longitudinal axis, and a third outer portion arranged to extend in the downstream direction.

10. The package of claim 9, wherein the droplet controller includes a male control unit coupled to the lid in a fixed position relative to the lid and arranged to extend in a downward direction away from the lid toward the container along the longitudinal axis and a female control unit coupled to the lid and arranged to lie in spaced-apart relationship to the male control unit to locate the female control unit between the male control unit and the container.

11. The package of claim 10, wherein the outer section of the flow-control passageway is defined by the male control unit and the lid.

12. The package of claim 11, wherein the damping chamber is defined by the female control unit, the male control unit, and an annular concave surface included in the lid and arranged to face toward the male control unit and the inner section of the flow-control passageway is defined by the male control unit and the female control unit.

13. The package of claim 10, wherein the damping chamber is defined by the female control unit, the male control unit, and an annular concave surface included in the lid and arranged to face toward the male control unit.

14. The package of claim 10, wherein the inner section of the flow-control passageway is defined by the male control unit and the female control unit.

15. A package comprising a container including a body formed to include an interior product-storage, region and a neck coupled to the body and formed to include a mouth opening into the interior-product storage region, a lid coupled to the neck of the container and formed to include a portion of a droplet passageway therein which is arranged to extend along a longitudinal axis of the lid, the droplet passageway being adapted to communicate a droplet of fluid from the interior region to an environment surrounding the package, and a droplet controller coupled to the lid to move therewith and configured to provide means for controlling discharge of the droplet of fluid stored in the interior region in response to pressurization of the fluid in the interior region so that a pre-determined size of the droplet and a predetermined rate of discharging the droplet occurs when the package is in any orientation and pressure is applied to the fluid stored in the interior product-storage region, wherein the droplet controller includes a male control unit coupled to the lid in a fixed position relative to the lid and arranged to extend in a downward direction away from the lid toward the container along the longitudinal axis and a female control unit coupled to the lid and arranged to he in spaced-apart relationship to the male control unit to locate the female control unit between the male control unit and the container, the male control unit, female control unit, and the lid cooperate to define a flow-control passageway therebetween and the flow-control passageway is in fluid communication with the interior product-storage region and the droplet passageway, and the female control unit includes an outer surface arranged to face away from the male control unit toward the lid, a first outer passageway surface arranged to extend from the outer surface toward the longitudinal axis, and a second outer passageway surface arranged to extend away from the outer surface toward the longitudinal axis, wherein the flow-control passageway includes an outer section, wherein the outer section of the flow-control passageway includes a first outer portion arranged to extend in a downstream direction, a second outer portion arranged to extend in an inward direction toward the longitudinal axis, and a third outer portion arranged to extend in the downstream direction, the female control unit having an inner surface surrounding the male control unit, wherein a transition between the second outer portion and at least one of the first outer portion and the third outer portion is curved.

16. The package of claim 15, wherein the female control unit further includes a third outer passageway surface arranged to extend between and interconnect the first and second outer passageway surfaces and the third outer passageway is arranged to lie in spaced-apart radial relation between the outer surface of the female control unit and the longitudinal axis.

17. The package of claim 15, wherein the female control unit further includes an upper surface arranged to face in an upward direction opposite the downward direction and a lower surface arranged to face in the downward direction toward the container and the female control unit extends between the upper and lower surfaces.

18. A closure comprising a lid adapted to couple to a neck of a container and formed to include a portion of a droplet passageway therein which is arranged to extend along a longitudinal axis of the lid and a droplet controller coupled to the lid to move therewith and configured to control discharge of the droplet of fluid stored in an interior product-storage region of the container in response to pressurization of the fluid in the interior region so that a pre-determined size of the droplet and a predetermined rate of discharging the droplet occurs when the closure is in any orientation and pressure is applied to the fluid stored in the interior product-storage region, wherein the droplet controller includes a male control unit coupled to the lid in a fixed position relative to the lid and arranged to extend in a downward direction away from the lid toward the container along the longitudinal axis and a female control unit coupled to the lid and arranged to lie in spaced-apart relationship to the male control unit to locate the female control unit between the male control unit and the container, the female control unit having a trench arranged to extend from an outer surface of the female control unit toward the longitudinal axis, the male control unit, female control unit, and the lid cooperate to define a flow-control passageway therebetween, the female control unit having an inner surface surrounding the male control unit, wherein the flow-control passageway includes an outer section, wherein the outer section of the flow-control passageway includes a first outer portion arranged to extend in a downstream direction, a second outer portion arranged to extend in an inward direction toward the longitudinal axis, and a third outer portion arranged to extend in the downstream direction wherein a transition between the second outer portion and at least one of the first outer portion and the third outer portion is curved.

* * * * *